United States Patent [19]

Veach

[11] 4,189,792

[45] Feb. 26, 1980

[54] PUSH BUTTON CONTROLLED WATER SYSTEM

[76] Inventor: Carlos W. Veach, 8921 Ashcroft Ave., Los Angeles, Calif. 90048

[21] Appl. No.: 942,992

[22] Filed: Sep. 18, 1978

[51] Int. Cl.[2] ..... E03C 1/04

[52] U.S. Cl. ..... 4/192; 137/607; 137/613; 251/25

[58] Field of Search ..... 4/192, 191, 166, 167; 251/25; 137/607, 613

[56] References Cited

U.S. PATENT DOCUMENTS

| | | | |
|---|---|---|---|
| 3,098,241 | 7/1963 | Booker et al. | 4/192 |
| 3,374,957 | 3/1968 | Tyler | 4/192 |
| 3,450,159 | 6/1969 | Wilkin | 4/192 |
| 3,638,680 | 2/1972 | Kopp | 4/192 |
| 3,719,308 | 3/1973 | Buchtel et al. | 137/613 |
| 3,794,292 | 2/1974 | Jaegtnes | 251/25 |

FOREIGN PATENT DOCUMENTS

| | | | |
|---|---|---|---|
| 503938 | 4/1939 | United Kingdom | 4/192 |

*Primary Examiner*—Houston S. Bell, Jr.

*Attorney, Agent, or Firm*—Victor C. Muller

[57] ABSTRACT

Tempered water supply system for a domestic basin, such as a bathroom lavatory, tub or shower, or a kitchen sink, characterized by an adjustable temperature mixing valve for hot and cold water, a supply valve including a hydraulic motor for controlling flow of tempered water from the mixing valve to an outlet such as a spout, and a pair of manual control valves for operating the motor. The control valves, and a manual control for the mixing valve, may be disposed at any desired positions on or relative to the basin. One control valve gradually moves the supply valve toward open position and the other similarly moves it toward closed position, which may be effected by continuous actuation or repeated incremental actuations, whereby actuation of one or the other increases or decreases outlet flow. Since the control valves are, in effect, servo-control valves for a servo-motor, and the flow rate therethrough is minor compared to the outlet flow rate, they may be connected with small readily orientable flexible conduits of desired lengths, enabling a wide selection of their positionings relative to the basin.

10 Claims, 10 Drawing Figures

FIG. 1
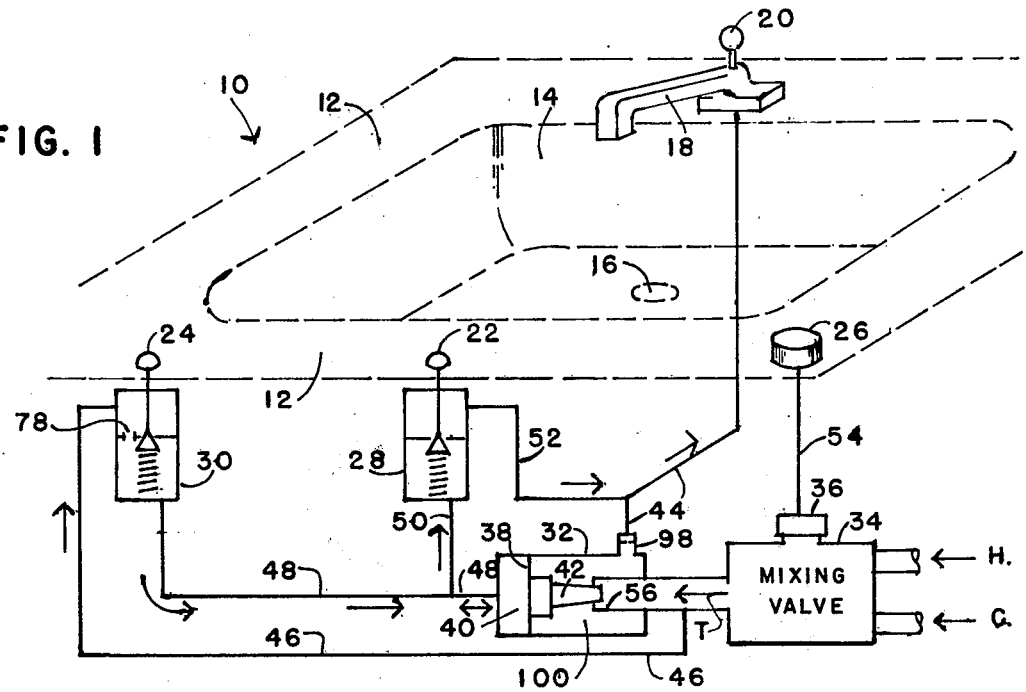
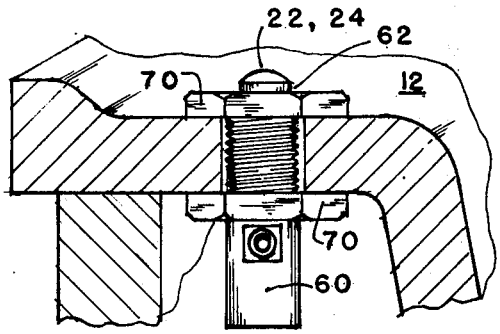
FIG. 3
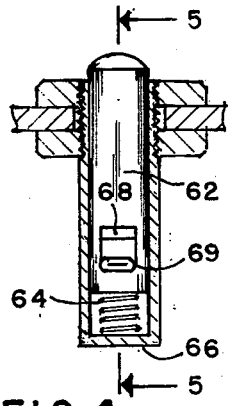
FIG. 4
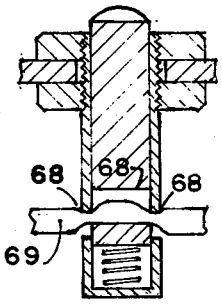
FIG. 5
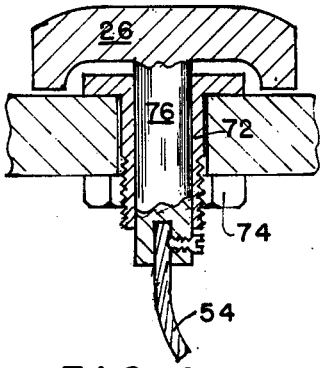
FIG. 6
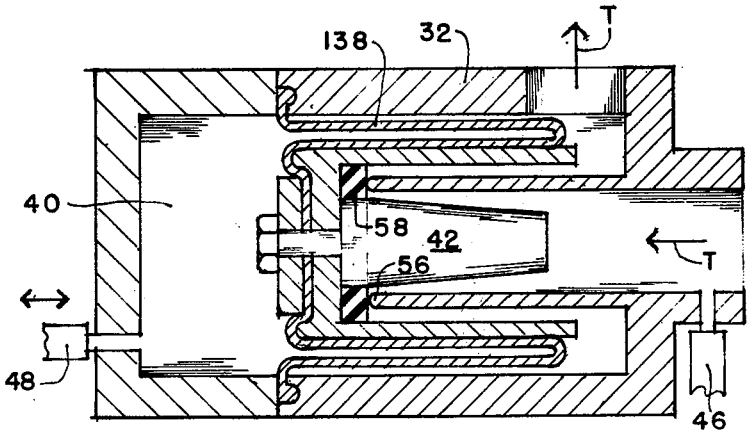
FIG. 2

PUSH BUTTON CONTROLLED WATER SYSTEM

BACKGROUND OF THE INVENTION

Pressurized sources of hot and cold water supplies for use in buildings, such as residences, are of relatively recent origin, most major developments of which probably occurred during the nineteenth century. In the early development, separate valves and spouts were employed and mixing occurred in a basin, such as a bathroom lavatory, tube, or kitchen sink. These are still used with laundry tubs. Later, the valves were incorporated into a unitary assembly with a single outlet or spout in which mixing occurs before discharge to the basin, which is a type now commonly in use. When employed with a shower, the outlet is usually connected to a shower head by a conduit of desired configuration. Such valve assemblies became standardized as to certain plumbing dimensions so that they would interchangeably fit basins furnished by various manufacturers (or vice versa). This standardization consisted, in the main, of providing basins with apertures in their surrounding surface or rim, usually adjacent the rear or wall side of the basin, in which the assembly is affixed. Present lavatories are often provided with three aligned apertures, the central aperture receiving a drain control rod and the outer two receiving integral conduits to which the water supplies are connected. Kitchen sinks are often provided with more than three apertures, at least one of which may receive an accessory. In any event, the apertures are predetermined by the basin manufacturer and the user is restricted to a selection of available basins and a selection of valve assemblies which may be employed therewith. While the selection within such combinations is quite wide and satisfies many users, it is nevertheless, restrictive. For example, if the user desires the spout in a rear corner of a basin rather than centrally thereof and valve controls disposed somewhat remotely adjacent the front edge thereof, such arrangement departs from the available standardization.

A recent refinement of the two valve single spout discharge assembly referred to comprises a single control for the two valves, which, by operating same in selected directions, controls temperature and discharge rate. Neither of the types referred to, however, are normally provided with an automatic temperature control valve. In the former, the hot and cold water valves are opened to meter the proper ratio of flow to obtain a desired temperature at which it will normally remain. If it is desired to change the discharge rate, both valves must be readjusted. In the latter type, a single control knob or handle has two differing motions. One motion preportions the hot and cold water and the other controls the discharge rate of the mixed water.

As will subsequently appear, the present invention further differs from the foregoing arrangement in that an automatic temperature mixing valve is provided which delivers water at a selected temperature at all flow rates and its discharge flow rate is controlled by a hydraulic servo-motor controlled by servo valves which may be disposed remotely, at will, from the mixing valve and spout.

SUMMARY OF THE INVENTION

The present invention provides a system comprising components which may be oriented relative to a basin or the like in various configurations characterized by an outlet, such as a spout, a remote mixed water supply valve, and servo-valves which may be installed at any desired loci for operating the supply valve. The servo-valves are preferably of the push button type which may be sequentially operated, or held depressed, to change the rate of flow of water through the outlet. A mixing valve, supplied by hot and cold water, is employed in the system which may be remotely disposed, as desired, and controlled by a third control which may be disposed in a desired location on or relative to the basin. An optional feature comprises a controlled leakage path associated with one of the push button valves for shutting off flow of meter to the outlet after a predetermined delay subsequent to use of the discharge.

One of the objects of the invention, accordingly, and consonant with the foregoing, comprises the provision of a system including a discharge spout for use with a domestic basin or the like, supplied by a remote flow control valve through which water of desired temperature flows, and controlled by servo valves which may be located at any desired positions.

Another object is to provide servo valves which may each be sequentially operated to cause the control valve to incremently open or close to thereby control the outlet discharge rate.

Another object, alternative to the foregoing object, is to operate one of the servo valves for a period sufficient to establish a desired flow after which the flow remains constant.

Another object is to provide a plurality of components which may be affixed to an existing basin, with minor alterations thereto, or to a basin designed especially for use with the components, whereby the components may be oriented relative to the basin in various configurations.

Another object is to provide servo valves and a temperature control of small size which may be readily affixed to an existing basin as a retrofit thereto or to a basin designed for same.

Another object is to provide a retrofit spout for use with the servo valves and temperature control.

Another object is to provide a system which minimizes seals or packings which require periodic maintenance.

Another object is to provide the system with means for automatically shutting off the water subsequent to normal use thereof.

A further object is to provide a system having simple and reliable components which may be furnished at a cost capable to prior valve assemblies.

Still further objects, advantages, and salient features will become more apparent from the detailed description to follow, the appended claims, and the accompanying drawing to now be briefly described.

BRIEF DESCRIPTION OF THE DRAWING

FIG. 1 is a diagrammatic illustration of an exemplary arrangement of components of the invention relative to a basin, illustrated by dotted lines;

FIG. 2 is a central section through an exemplary water supply valve, forming a component of FIG. 1;

FIG. 3 is an actual size side elevation of an exemplary control valve in open position, also forming a component of FIG. 1;

FIG. 4 is a central section of the control valve of FIG. 3 in closed position;

FIG. 5 is a section taken on line 5—5, FIG. 4;

FIG. 6 is a central section of an exemplary temperature control forming a component of FIG. 1;

DETAILED DESCRIPTION OF PREFERRED EMBODIMENTS

Figure 7:
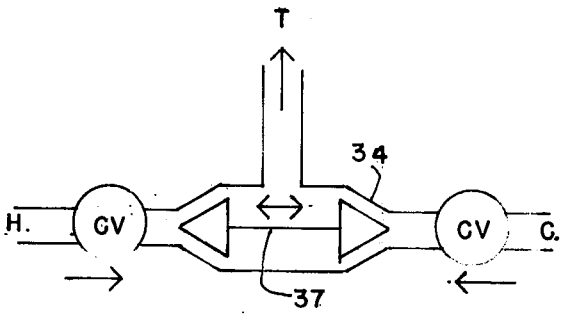
FIG. 7 is a diagrammatic mixing valve.

Referring now to the drawing in detail, and first to the diagrammatic illustration of FIG. 1, basin 10, illustrated in phantom or dotted lines, may be a bathroom lavatory, kitchen sink, or the like, which is of conventional design, except as subsequently set forth, and with which novel components of the invention are associated. The conventional design includes a substantial flat top rim 12 surrounding a recessed receptacle or basin 14 provided with a drain 16, all of which may form the top portion of a cabinet (not shown) disposed beneath the dotted lines which provides space for plumbing and storage. Spout 18, which may be provided with a knob 20 for operating a drain valve, is also conventional to the extent that it discharges mixed hot and cold water but differs in that it is solely a spout and not a part of a conventional assembly which also includes hot and cold water valves forming integral parts thereof. Other components which differ from the conventional spout-valve unitary assembly just referred to, comprise a depressible control "on" push button 22, a like "off" push button 24, and a temperature control knob 26. Components which differ from the conventional and are disposed beneath the dotted lines or within the cabinet comprise a control valve 28 operated by push button 22, a like control valve 30 operated by push button 24, a water supply valve 32 and a mixing valve 34, connected to sources of hot and cold water. Mixing valve 34 in its most simplified and inexpensive form may be of the proportional metering type which is provided with a rotatable element 36 which may be selectively set and which effects metering of hot and cold water, to provide tempered water for delivery to the supply valve 32, the temperature of the discharged water being substantially constant at all rates of flow thereof. FIG. 7 diagrammatically illustrates such a valve in which pintle 37 may move between hot water Outlet H and cold water outlet C and deliver tempered water T to supply valve 32. As will be apparent, depending upon the position of the pintle, the outlet water may be all hot, all cold, or a proportionate mixture thereof. Check valves CV prevent cross flow of water between the hot and cold supplies.

Still referring to FIG. 1, supply valve 32 is provided with a movable wall 38, forming one end of an expansible chamber 40, and a metering pintle 42 is affixed to the wall. As will be apparent, the rate of flow of tempered water depends upon the axial position of the pintle, which in turn, is controlled by the volume of water in chamber 40. The tempered water flows from supply valve 32 to spout 18 through conduit 44.

Control valve 30 receives water from the water source upstream from supply valve 32 through conduit 46 and discharges same to chamber 40 through conduit 48. Control valve 28 receives water from chamber 40, through conduits 48,50 and discharges same to conduit 44 through conduit 52. Before proceeding to further details of preferred components, the operation may now be understood, still referring to FIG. 1.

Operation

It will be assumed that chamber 40 is at maximum volume and pressure, thus positioning pintle 42 at its closed position and that temperature knob 26 has been moved to a selected position, thus moving element 36 to like position through link 54. "On" push button 22 is then depressed, permitting water in chamber 40 to discharge to conduit 44 through valve 28 and conduit 52. The extent of opening of pintle 42 will be dependent on the time the push button is depressed. This may be a single depression or a series of sequential depressions so that the flow to the spout may be selected, as desired. When push button 22 is released, the water in chamber 40 is trapped and discharge to the spout now remains constant. When it is desired to reduce the flow or discontinue same, push button 24 is depressed and water flows through conduit 46, valve 30 and conduit 48 to chamber 40, increasing its volume and moving the pintle toward closed position. This may be a single depression or a series of sequential depressions, incremently moving the pintle toward closed position in the same manner that it may move toward open position. When moved to closed position, water trapped in chamber 40 retains the pintle in closed position until push button 22 is again depressed.

A restricting orifice 98 is preferably provided between chamber 100 and conduit 44 to ensure a small pressure differential therebetween at all flow rates. Thus if control valve 30 is closed and control valve 28 is opened the pressure in chamber 100 will always exceed that in chamber 40 and the movable wall will move to the left, further opening the pintle.

During opening of the control valve 28, the pressure in chamber 40 decays to substantially ambient pressure, and supply pressure, acting on the pintle cross section produces a force sufficient to move it toward open position. During this movement it is aided by pressure on the right side of the movable wall which has an area considerably in excess of that of the pintle. During closing the pintle, the pressure in chamber 40 is somewhat less than supply pressure but since the area of the wall exceeds that of the pintle it moves toward closed position. It will now be apparent that wall 40 is actually a water motor which may move the pintle, utilizing the pressurized supply as a source of energy. It will also be apparent that the area of wall 38 must exceed that of the maximum cross section of pintle 42, that is, the area of outlet 56 which it closes.

Preferred Components

While the general description of the schematic operative components is apparent from only FIG. 1, a more detailed description thereof will enable those skilled in the art to better practice the invention, particularly from a point of view of a judicious selection of economical and reliable components.

Supply valve 32 is preferably of a form in which its pintle 42 is provided with considerable motion and moves relatively slowly so that the operator is accorded an appreciable time to change flow rate, as distinguished from a rapid change from full closed to full open positions. Also, it should preferably be devoid of seal rings which require maintenance to prevent leakage. FIG. 2 illustrates such a form in which wall 138 folds along itself as pintle 42 moves, such type of wall being that supplied by the Bellowfram Corp., Burlington, Mass., and known as a rolling diaphragm. As distinguished from a slideable piston, it requires no seal ring and as distinguished from a conventional diaphragm, even one of the type having concentric convolutions therein, may be subjected to considerably more axial distortion. Pintle 42 is also tapered so that flow gradually varies between ends of its movement and is thus a metering valve. Preferably an elastomeric washer 58, such as neoprene, is provided which engages the end of outlet 56 when the pintle moves to closed position, thus obviating leakage across same.

The rate of flow through conduits 46, 48, 50 and 52, to and from chamber 40 is also controlled. Conduits with an internal diameter of no greater than 1/16" will normally suffice which inherently limit flow rate. As illustrated, the conduits are readily flexible tubing, such as rubber or plastic, the ends of which may be readily connected to the components and which may be routed therebetween without bending, as usually required with so called rigid tubing.

The "on" and "off" control valves, best shown in FIGS. 3–5 are alike and of a size approximately as shown in FIG. 3, that is, about ½" diameter which may be installed within an aperture of such size. Each valve comprises a tube 60, and a slideable plunger 62 therein, urged in one direction by a spring 64, one end of which engages a wall 66 or the like at one end of the tube. Square transverse aligned apertures 68 are provided in both members through which a control conduit 69 extends. FIGS. 4 and 5 illustrate the closed position in which the spring causes the conduit to be squeezed to closed position and FIG. 3 illustrates a button 22 or 24 depressed against the urge of the spring, permitting the conduit to assume its circular open position. Mounting of a control valve on the basin may be effected by a pair of nuts 70 which threadedly engage the tube and abut opposite faces of basin rim 12.

Temperature control 26, best shown in FIG. 6, comprises a shouldered and threaded sleeve 72, secured to the basin rim with a nut 74, providing a bearing support for a rotatable shaft 76 to the upper end of which knob 26 is affixed and to the lower end of which is affixed link 54. Link 54 may be in the form of a flexible wire if knob 26 is disposed approximately in alignment with control 36 on the mixing valve. If not, it may be connected with conventional flexible sheathed Bowden cable and wire or other flexible link. Sleeve 72, like the control valves, may be disposed in a like small aperture in the basin rim.

Another feature previously alluded to comprises means for discontinuing flow to the spout after lapse of a time of non-use. With reference to FIG. 1, this may be in the form of a small bleed or leak aperture 78 which by-passes "off" valve 30 and which will deliver water to chamber 40, for closing the supply valve after a desired lapse of time subsequent to normal use of the basin. Alternatively, but not shown, a piece of porous string may be disposed within the tube of the "off" valve where it passes through the squeeze apertures of FIGS. 4 and 5, so that when the tube is squeezed together the string is disposed therein and water bleeds through the string.

Figure 8:
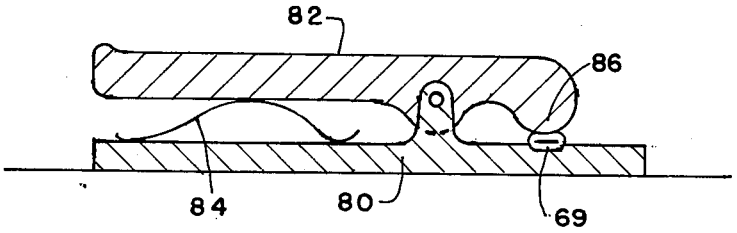
FIG. 8 is a control valve, like that of FIGS. 3-5, but operated by the foot of a user.

FIG. 8 illustrates an alternative form of control valve which may be operated by a foot of an operator. A base 80 affixed to the floor in any suitable manner pivotally supports a lever 82 urged by a spring 84 and having a clamping end 86 which engages a flexible tube as previously described, which, as shown, is squeezed to "off" position by the spring. When the pedal is depressed, the tube opens in the same manner as previously described for the finger push button type valve. This type of control may be expediently employed by those whose hands are not free to operate the finger push button type of FIGS. 3–5, such as doctors, chemists, or other who desire a control while both hands are engaged in performance of a desired function.

Figure 9:
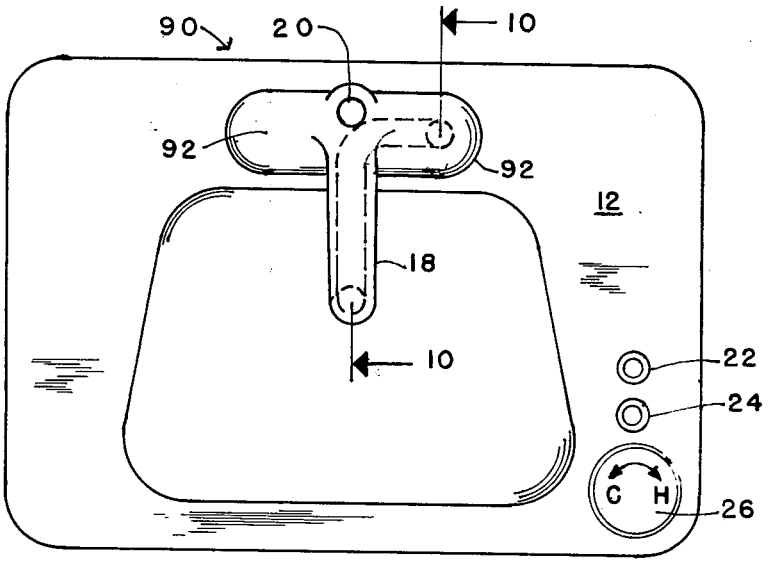
FIG. 9 is a top plan of an exemplary basin employing certain of the components.
Figure 10:
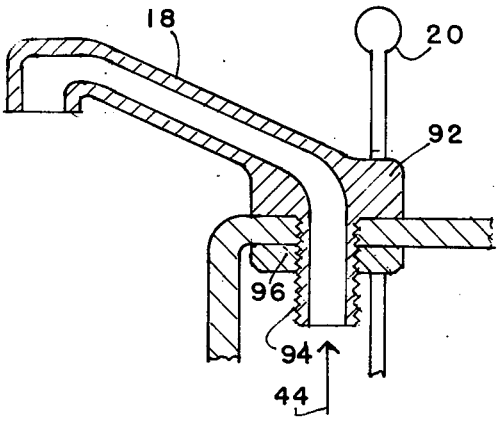
FIG. 10 is an enlarged section taken on line 10—10, FIG. 9.

FIGS. 9 and 10 illustrate a retrofit to a conventional lavatory employing components previously described. It will be assumed that it is of the three aligned hole type (not shown) utilizing an integral assembly including a central spout and a valve at each side thereof, each of which is provided with a threaded tube for securing the assembly to the basin rim and a central rod for controlling the drain. The hot and cold water supplies are also connected to the threaded tubes, all as understood in the art. Outlet 90 includes lateral wing portions 92,92 which cover the existing apertures in the rim and support spout 18 which may be an integral part thereof. A threaded conduit 94 and a nut 96 secures the unit to the basin and tempered water conduit 44 is connected to same in conventional manner. If desired, a like threaded member and nut may be employed with the other wing 92 for added securement. Drain control 20 extends through the basin control aperture in conventional manner. As will be apparent, such unit may have the general appearance of a conventional fixture but is devoid of the hot and cold water valves and their control knobs or handles on the wings at each side of the spout. Push buttons 22,24 and temperature control 26 may be disposed on the basin rim, the positions shown being exemplary, only.

In the example just described, it will be apparent that the wing shaped base 92,92 which supports spout 18 is larger than required solely for water flow, the wing portions being illustrated only to cover conventional existing apertures in the basin rim for acceptable appearance. If only a single aperture were present, the wing portions would not be required and the spout base could be considerably smaller, such as a simple flange or like abutment surrounding the spout. A single apertured basin, however, is not the conventional available type. To provide a single aperture basin, moreover, would still restrict the user to a spout location selected by the basin manufacturer. One of the concepts of the invention, accordingly, is to provide an apertureless basin but with a rim designed to accommodate a spout in any of various possible positions. The user may then drill a hole in a position to suit his desires. Normally an aperture of about ¾" or less will suffice for the threaded tubular mounting conduit or spout shank. With this possibility open to the basin designer, and no longer being restricted to the use of a standardized spout and valve assembly, it will be apparent that basin design may take new forms, limited only by the imagination of the designer. In short, the single spout without attached valves, and the small control valves which may be oriented at will remote from the spout, provide a system heretofore unavailable with which numerous combinations of orientation of the components will become possible. In addition to the advantages of flexibility in locating the components, the push button controls for water flow will be appealing to many users and particularly those who favor the modern power control of functions under command of push buttons.

Some users, however, may prefer the present location of flow controls adjacent the spout rather than remote therefrom, as described, but would welcome push buttons instead of knobs or handles. To satisfy this desire, the push button may be located on the wings 92,92 adjacent the spout, that is, in the same positions conventionally occupied by the knobs and their associated valves below same. Other modifications within the purview of the invention will become apparent from the foregoing. For example, the fixed position spout illustrated may be swivelly connected to its base for use with a compartmented kitchen sink. The push buttons may be disposed in positions other than on the basin rim (some of which have been previously described) such as in a wall which would be expedient in connection with a bathtub or stall shower. If variation in temperature of tempered water is only infrequently required, the temperature control may be disposed in a less accessible location where it is not likely to be changed by the curious, such as children. For the latter, this could be desirable to prevent an inadvertent setting for a scalding water flow. Thus, while the positioning of the "on" and "off" push buttons will normally be chosen in a optimum position of accessibility, the positioning of the temperature control will not necessarily be so. While a rolling diaphragm type of supply valve is ideally suited for the purpose, other functionally equivalent metering valves may be employed. Similarly, while squeeze type control valves are illustrated, for purposes of simplicity and economy, other functionally equivalent valves may be employed. Since the outlet or spout is for tempered water flow, only, and is not directly associated hot and cold water supplies affixed thereto, its configuration may be varied within wide limits.

What is claimed is:

1. In a water supply system for a basin, such as a bathroom lavatory, kitchen sink, or the like, including a spout for delivering tempered water, consisting of a mixture of hot and cold water, to the spout for discharge into the basin, the improvements, comprising;

(a) a water source including water mixing apparatus communicating with supplies of hot and cold water adapted to mix same in selected proportions for delivery therefrom of water at a desired temperature, (b) a supply valve communicating between the mixing apparatus and the spout having a movable wall forming a part of an expansible chamber and operatively connected to a metering valve for varying the rate of flow of the delivered water, dependent upon the volume of water in said chamber, (c) a first normally closed control valve communicating with the chamber adapted to be opened by a manual controls to decrease its volume and permit the metering valve to move toward open position, and (d) a second normally closed control valve communicating between the source and the chamber adapted to be opened by another manual controls to increase its volume and move the metering valve toward closed position.

2. A system in accordance with claim 1 wherein the basin is provided with a surface thereabove forming a rim thereabout, and apertures extending through said rim at selected positions therein in which the manual controls are disposed, whereby the positioning of the manual controls with respect to the spout may be selected as desired.

3. A system in accordance with claim 2, including a manually movable temperature control device affixed to the rim in like manner and operatively connected to the mixing valve.

4. A system in accordance with claim 1 wherein the control valves communicate with the chamber and source through relatively small conduits which may be readily oriented therebetween and which are of a size to permit a relatively small flow of water, as compared to the flow to the spout.

5. A system in accordance with claim 4 including a like conduit communication the first named control valve with a conduit communicating the supply valve and spout, whereby water flowing through the first control valve is discharged to the spout.

6. A system in accordance with claim 4 wherein the conduits, at least in the locus of the control valves, are flexible and adapted to be squeezed to flattened condition to prevent flow therethrough, and said control valves are provided with resilient means for squeezing the conduits, the control valves, when actuated in a direction opposing the resilient means, permitting the conduits to open for flow therethrough.

7. A system in accordance with claim 1 wherein said movable wall is of the folding diaphragm type.

8. A system in accordance with claim 1 wherein the spout is disposed in an existing aperture in the basin and the manual controls are disposed in apertures formed therein and disposed remotely therefrom.

9. A system in accordance with claim 1 including a bleed path for closing the metering valve after a predetermined time in the event the second control valve is not operated.

10. A system in accordance with claim 2 wherein each manual control forms a part of its associated control valve.

* * * * *